US006363825B1

(12) United States Patent
Hagleitner

(10) Patent No.: US 6,363,825 B1
(45) Date of Patent: Apr. 2, 2002

(54) BLADE GUIDE FOR A DEVICE FOR DISPENSING OF PAPER SECTIONS

(75) Inventor: Hans Georg Hagleitner, Zell am See (AT)

(73) Assignee: Hagleitner Betriebshygiene Ges. m.b.H. & Co. KG (AT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/171,305

(22) PCT Filed: Apr. 24, 1997

(86) PCT No.: PCT/AT97/00079

§ 371 Date: Oct. 15, 1998

§ 102(e) Date: Oct. 15, 1998

(87) PCT Pub. No.: WO97/40731

PCT Pub. Date: Nov. 6, 1997

(30) Foreign Application Priority Data

Apr. 25, 1996 (AT) ..... 752/96

(51) Int. Cl.[7] ..... B26D 1/62
(52) U.S. Cl. ..... 83/337; 83/649; 83/949
(58) Field of Search ..... 83/337, 564, 649, 83/650, 327, 334, 335, 949

(56) References Cited

U.S. PATENT DOCUMENTS

| | | | | | |
|---|---|---|---|---|---|
| 4,142,431 | A | * | 3/1979 | Jespersen | 83/649 |
| 4,186,633 | A | | 2/1980 | Baumann | |
| 4,307,639 | A | | 12/1981 | DeLuca | |
| 4,404,880 | A | * | 9/1983 | DeLuca | 83/337 |
| 4,441,392 | A | * | 4/1984 | DeLuca | 83/335 |
| 4,712,461 | A | | 12/1987 | Rasmussen | |
| 5,048,386 | A | * | 9/1991 | DeLuca et al. | 83/337 |
| 5,441,189 | A | * | 8/1995 | Formon et al. | 83/337 |
| 5,937,718 | A | * | 8/1999 | Granger | 83/337 |
| 5,979,284 | A | * | 11/1999 | Granger | 83/650 |

FOREIGN PATENT DOCUMENTS

| | | | |
|---|---|---|---|
| DE | 28 14 792 A | 10/1978 | B65H/35/08 |
| DE | 36 90 545 | 5/1990 | B65H/35/08 |
| EP | 629 372 A | 12/1994 | A47K/10/34 |
| FR | 2 596 034 A | 9/1987 | B65H/35/04 |
| WO | WO 87/02294 | 4/1987 | B26D/1/56 |

* cited by examiner

*Primary Examiner*—Kenneth E. Peterson
(74) *Attorney, Agent, or Firm*—Lorusso & Loud

(57) ABSTRACT

The invention relates to a device for dispensing of paper sections, which has a rotatable roller (1) provided with a slot (4), and a blade (5) arranged in the roller (1). The blade (5) is arranged on a carrier (7) pivotable inside the roller (1) and can be moved outwardly through the slot (4) to separate each paper section respectively across one part of the roller turn. A four-bar linkage is used to guide the blade (5) which is either articulated to the pivotable carrier (7) and displaceable in a slide guide (8) or articulated to two carriers (7, 9) tiltable about parallel axes (11, 12).

4 Claims, 3 Drawing Sheets

BLADE GUIDE FOR A DEVICE FOR DISPENSING OF PAPER SECTIONS

The invention relates to a blade guide for a device for dispensing paper pieces, with a rotatable roller provided with a slit and over which a paper web is conveyed, and with a blade which is arranged on a carrier pivotable inside the roller and which is outwardly moveable through the slit for a part of the rotation of the roller for forming a tear-off perforation in the paper web.

Figure 10:
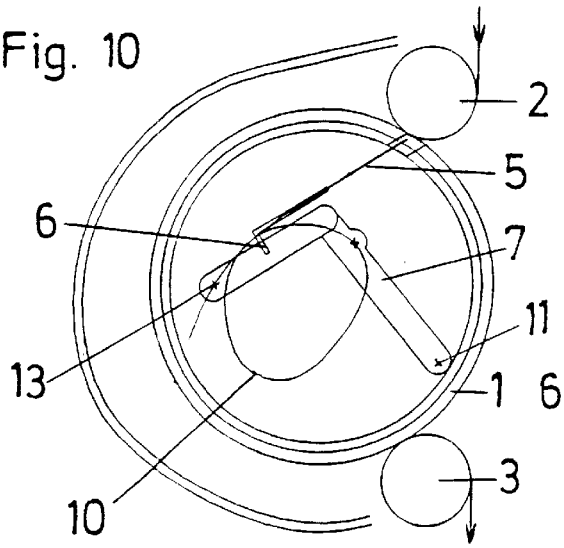
Figure 11:
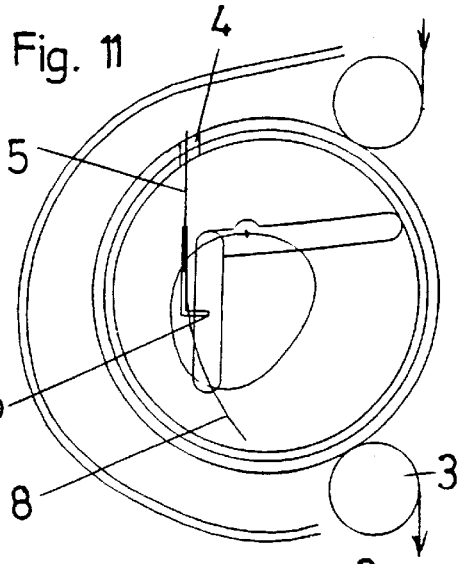
Figure 12:
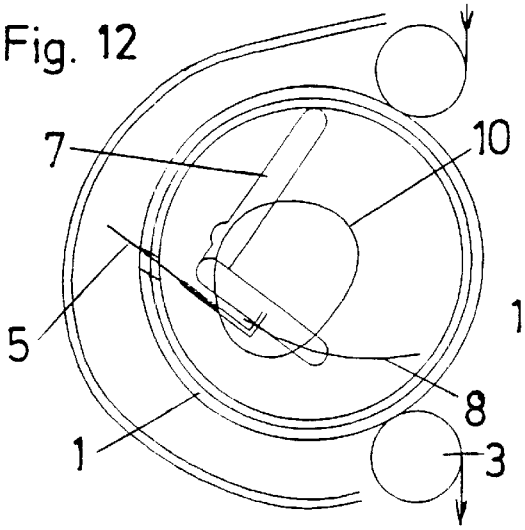
Figure 13:
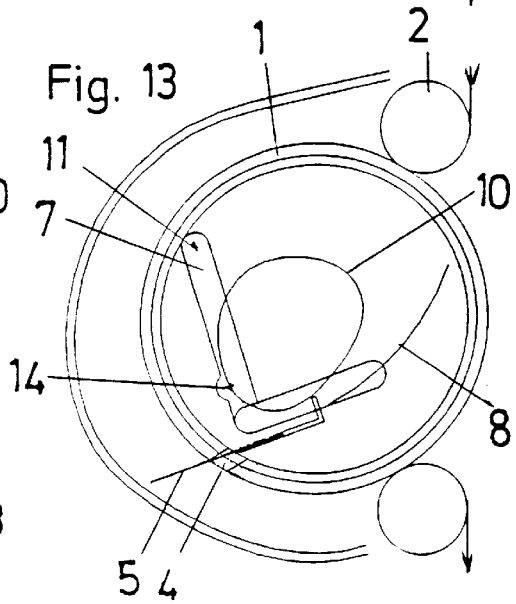
Figure 14:
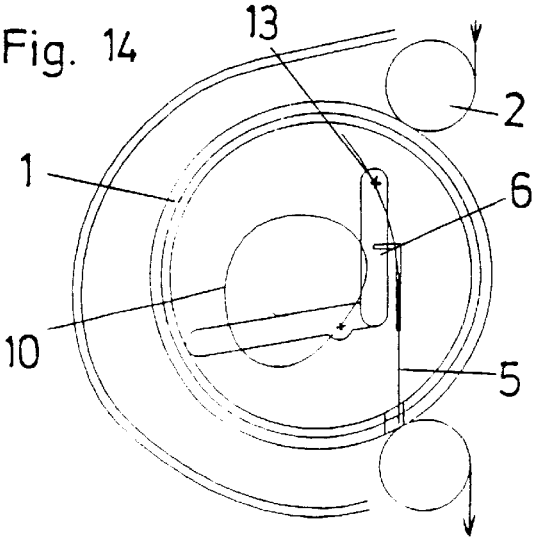
Figure 15:
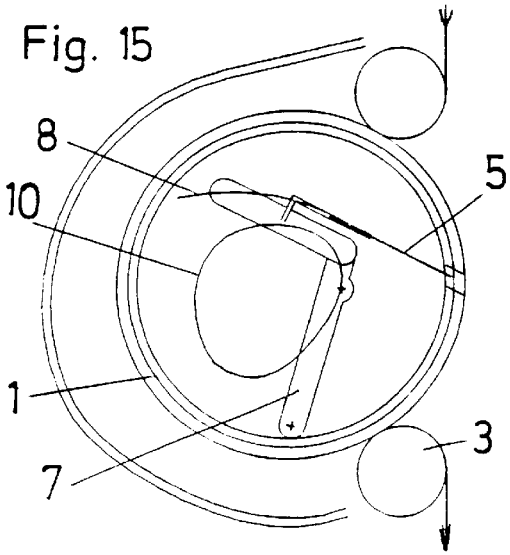

Such devices, which are used in particular as paper towel dispensers in sanitary facilities, are known, for example, in different embodiments from DE-A 28 14 792. In FIGS. 12 and 13 of the DE-A document, the blade projects approximately perpendicularly from the carrier, wherein, when viewed from an end face, an overall hook-like shape is produced. The carrier is composed of two arms which are pivotally mounted close to the peripheral wall of the roller, respectively in an end wall of the roller, about a common axle which, viewed in the direction of rotation, lies in front of the slit. When the roller is rotated, the blade moves in an arc of a circle through the slit, wherein the carrier lies either on a stationary plate cam or is driven by a crank arm which is mounted on a stationary axle parallel to the roller axle. FIGS. 10 and 11 of DE-A 28 14 792 show an embodiment in which the blade is rotatably mounted on an axle parallel to the roller axle and, guided by the slit in the roller wall, is rotated about the axle. Because of the axle spacing, the blade then projects out of the roller over a part of the revolution of the roller.

The blade guide according to DE-C 36 90 545 includes a carriage which can be displaced into a diameter of the roller, on which carriage the blade is arranged parallel to the direction of displacement and moves outwardly through the slit in a straight line.

According to the strength and elasticity of the paper web to be cut, which is guided over a feed-in press roller, the blade roller and a feed-out press roller, it may happen that the blade does not cut through the paper web, but instead only lifts it from the blade roller. The object of the invention is therefore to provide a blade guide by means of which the blade additionally tensions the paper web in the direction of the periphery of the roller such that perforation does actually take place.

In accordance with the invention, in a first embodiment this can be achieved in that the blade is linked onto the pivotable carrier, and can be moved in a slideway. In an equally advantageous alternative, the object can be solved in a second embodiment in that the blade is linked to two carriers pivotable about parallel axes.

Both embodiments are based on the four-bar linkage principle, in which the blade forms the connecting element, wherein in the first embodiment, a second pivotable carrier is replaced with a joint which is displaceable in the slideway. In this way the cutter blade can be provided with a movement other than a straight one or an arc of a circle about the pivot axle of the carrier, which at first makes it possible for it to be pushed out an angle which causes the teeth of the cutter blade to grip the paper web, and it then inclines in the direction of the periphery of the roller, wherein the paper web is tensioned such that even when the paper web has a high degree of elasticity and strength, the teeth penetrate it and perforate it.

Preferred embodiments propose that the slideway is configured in an arc of a circle, wherein the radius of the slideway is different from the radius of the pivotable carrier, or that the two pivotable carriers form parallelogram rods.

During one rotation of the roller, in a first part of the revolution of the roller, which covers an angle of rotation of, for example, 240°, the blade is pushed out and then withdrawn again, and in the remaining second part of the revolution of the roller, which covers the remaining angle of rotation of, for example, 120°, remains withdrawn. In a preferred embodiment, this is achieved in that the pivotable carrier is guided along a fixed curved path which is not in the shape of an arc of a circle.

The invention will hereinafter be described in more detail, with reference to the attached drawings, without being limited thereto.

Figure 1:
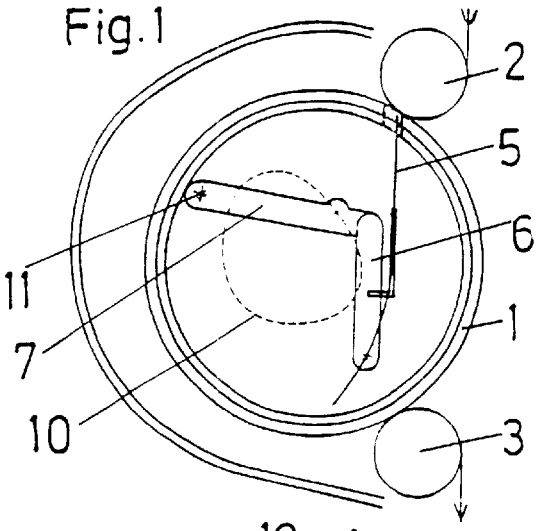
Figure 2:
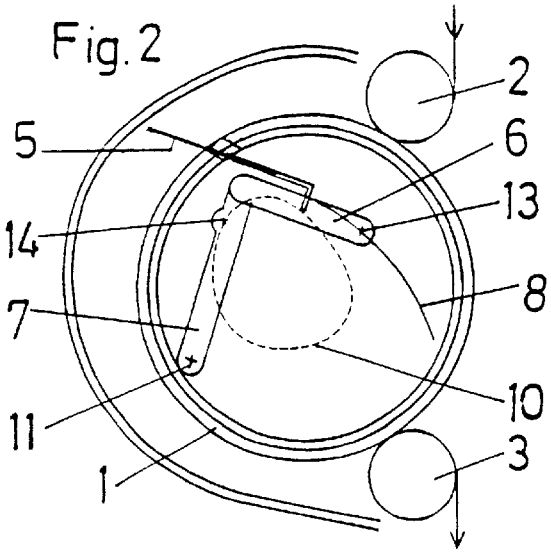
Figure 3:
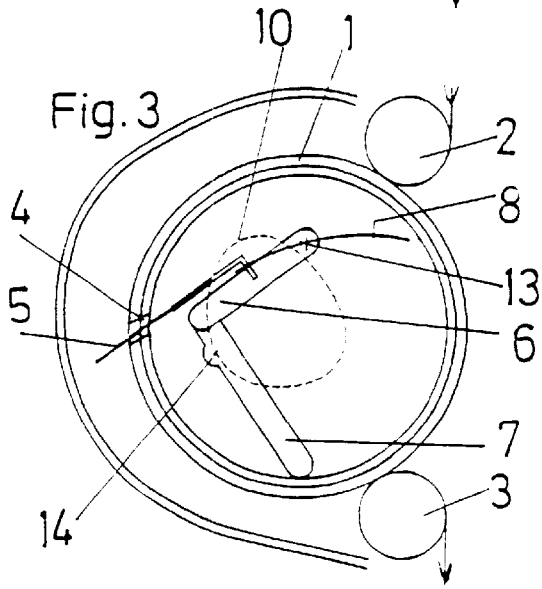
Figure 4:
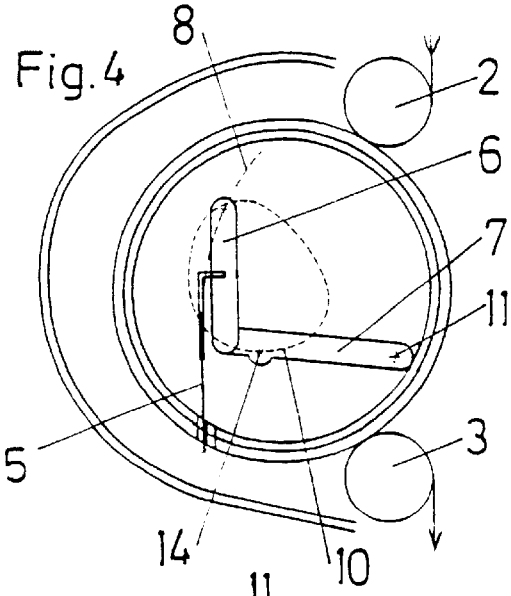
Figure 5:
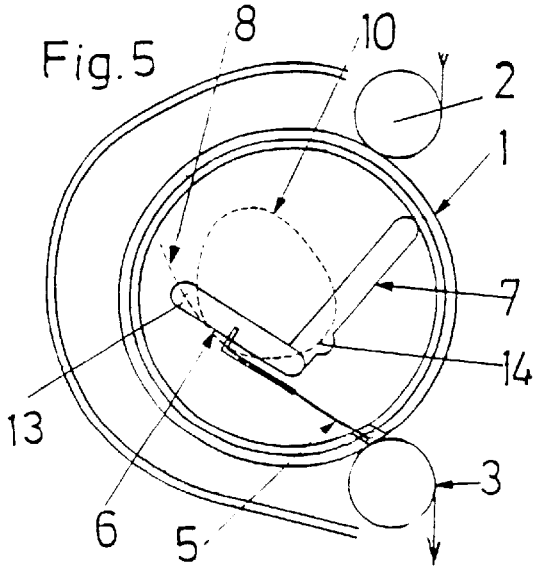
Figure 6:
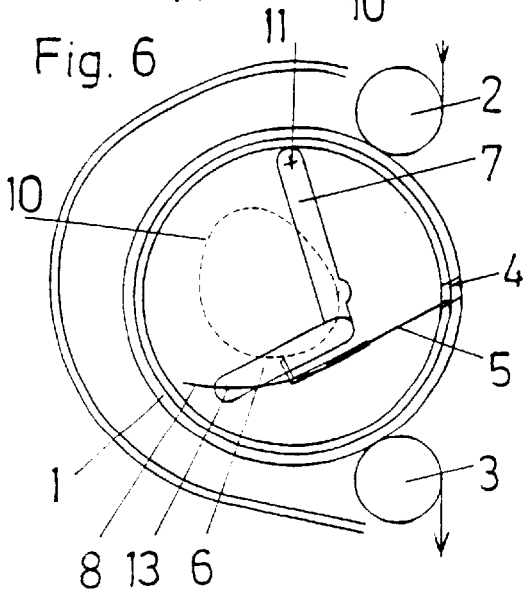
Figure 7:
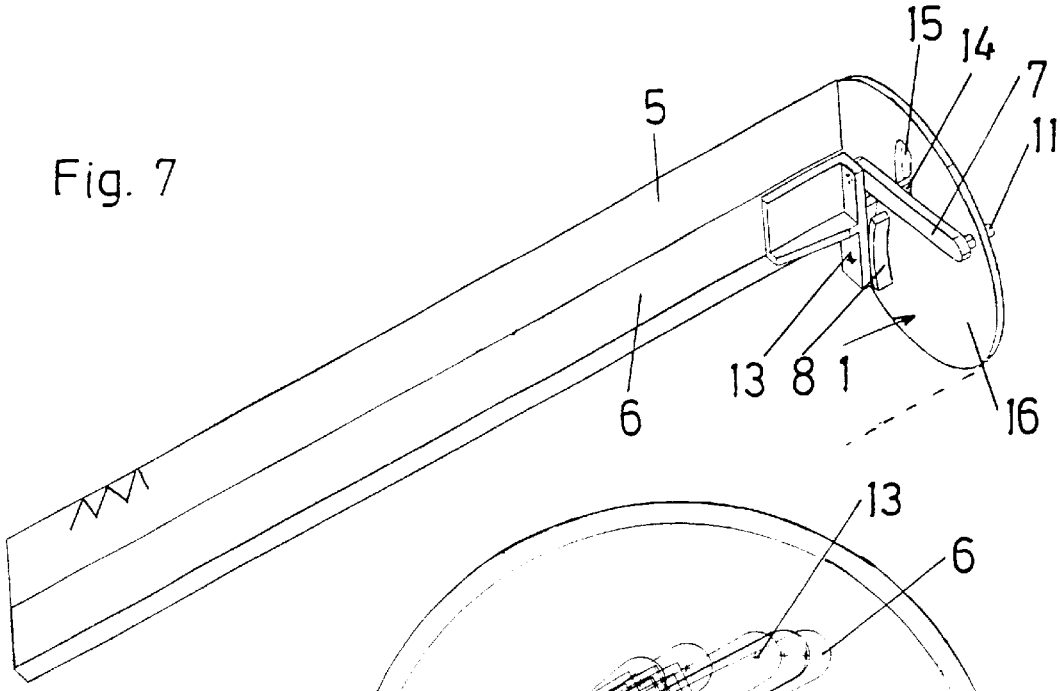
Figure 8:
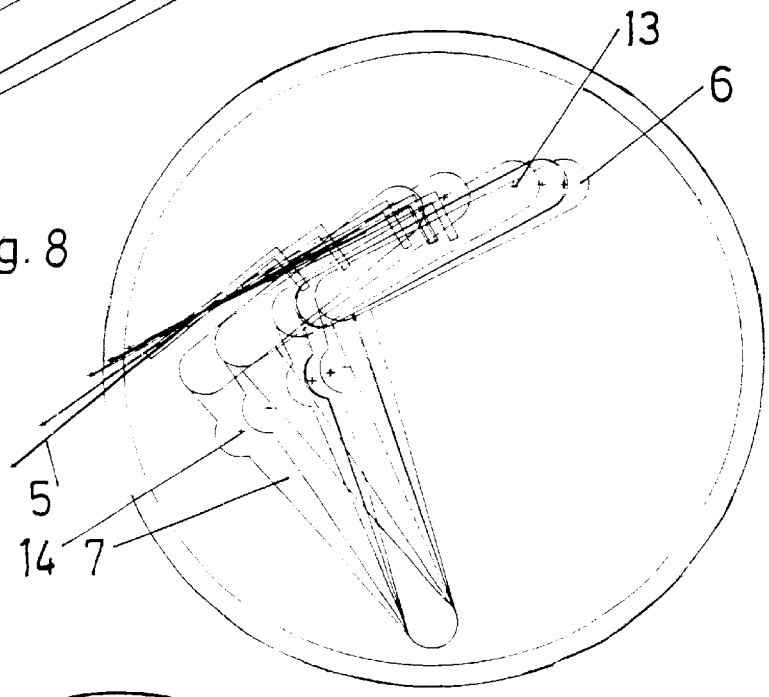
Figure 9:
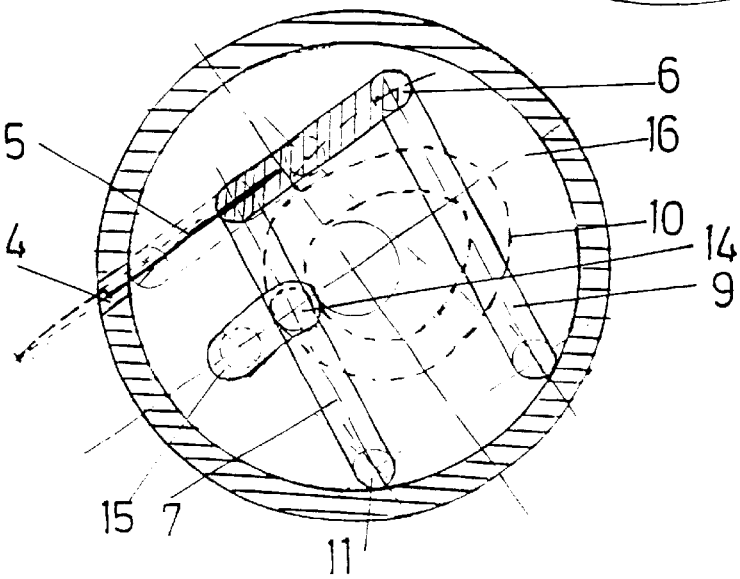

In these is shown, in:

FIGS. 1 to 6 schematic views of the blade roller and of the blade guide in a first embodiment, in each case rotated by 60°, FIG. 7 a part view, at an angle, of the blade guide, FIG. 8 a schematic end face view of five different positions of the blade movement, and FIG. 9 a diagram, similar to FIG. 8, of a second embodiment, and FIGS. 10 to 15 schematic end face views of the blade roller and of the blade guide in a third embodiment, in each case rotated by 60°.

A device for dispensing paper pieces, for example a paper towel dispenser, is provided with a rotatable roller 1 to which the uncut paper web is fed from a stock roller by means of a feed-in press roller 2. The paper web loops around the larger area of the roller 1 and arrives, via the feed-out press roller 3, at the dispensing point. The paper pieces can be detached from the paper web as soon as a perforation line is made at right-angles in the paper web by means of a blade 5, in particular with teeth. For this, during the revolution of the roller 1, the blade rotating with it is pushed out of the roller 1 through a slit 4, wherein the blade moves along a path curved in the direction of rotation of the roller. Even a paper web with a high degree of elasticity and strength is thus not only lifted up from the roller but is increasingly tensioned until the teeth finally stick in, as the angle of exit, which is at first large, becomes increasingly smaller. In the embodiments according to FIGS. 1 to 9 the tensioning of the paper web thus takes place between the feed-in press roller 2 and the teeth of the blade, which project from the roller in the direction of revolution of the roller. In the embodiment according to FIGS. 10 to 15, the tensioning of the paper web takes place between the feed-out press roller 3 and the teeth of the blade, which project from the roller in the direction opposite the direction of rotation of the roller. In the embodiments according to FIGS. 1 to 8, and 10 to 15, the blade guide necessary for this includes a carrier 7 pivotable about an axle 11, which carrier is composed of two arms, respectively coupled to an end plate 16 of the roller, and a blade holder 6 joining them in an articulated manner, and a slideway 8 which is composed respectively of two bars projecting from the inside surfaces of the end plates 16, in particular curved bars, between which a guide pin 13 engages. A slit 15 in each end plate 16, concentric to the axle 11, is passed through by a guide stud 14 which engages in a fixed curved path 10, which is configured according to the desired movement of the blade 5. The curved path 10 runs such that in the area with a smaller angle, between the press rollers 2 and 3, the cutter blade lies inside the slit 4 in the roller 1 (FIGS. 6, 15), and in the area with a larger angle goes out and then withdraws (FIGS. 1 to 5, 10 to 14).

The movement, in kinematic reversal, of the blade can be seen from FIG. 8, when the roller 1 is held and the curved path 10 is rotated about the roller axle.

In the embodiment according to FIG. 9, the blade guide is made by two pivotable carriers which respectively comprise a pair of arms coupled to the end faces 16. As shown, the carriers 7, 9 can be arranged, having the same length and being parallel to one another, in the manner of a parallelogram guide. However, when a path of the cutter blade which is not in the shape of an arc of a circle is desired or necessary, they can also be varied in their lengths and spacings. In this embodiment also, a carrier 7 is provided with two guide studs 14 engaging in the fixed curved paths 10, which pass through the slits 15 in the end faces 16.

What is claimed is:

1. A blade guide for forming a tear-off perforation in a paper web, when the paper web is being conveyed through a device for dispensing paper pieces, said blade guide comprising:

a rotatable roller provided with a slit over which the paper web is conveyed;

a pair of endplates mounted on said rotatable roller;

a blade which outwardly moves through the slit of said rotatable roller during a part of the rotation of said roller by action of a two bar linkage comprising:

a blade carrier composed of two arms upon which said blade is pivotally mounted to each of said arms forming a connecting element between each said arm;

an axel for each said arm, to which each said arm is pivotally mounted respectively to both said endplate and pivotally mounted within said rotatable roller;

a slideway formed within said endplate of said rotatable roller in which a portion of said blade is guided;

a guide pin mounted to said blade which engages said slideway;

a curved path which guides said blade carrier and said blade outwardly through the slit of said rotatable roller during a part of said rotation of said roller; and, a guide stud mounted to each said arm which lies within and follows said curved path causing movement of said blade through said rotatable roller during part of the rotation.

2. The blade guide of claim 1 wherein said slideway is in the shape of an arc of a circle having a first radius, and each of said blades have a second radius of motion, and wherein said first radius differs from said second radius.

3. The blade guide of claim 2 wherein said blade moves along a path curved in the direction of the rotation of the roller.

4. The blade guide of claim 2 wherein said blade has a movement other than a straight one which causes said blade to grip the paper web and then incline in the direction of the periphery of said roller.

* * * * *